US008731231B2

(12) United States Patent
Teske-Fischer et al.

(10) Patent No.: US 8,731,231 B2
(45) Date of Patent: May 20, 2014

(54) DYNAMIC SOUND TRANSDUCER AND RECEIVER

(75) Inventors: Till Teske-Fischer, Wuerzburg (DE); Markus Kuhr, Singapore (SG); Vladimir Gorelik, Hanover (DE); Dirk Hackbarth, Ahlem (DE); Heinz Epping, Hildesheim (DE); Burkhard Markmann, Wedemark (DE); Axel Grell, Burgdorf (DE); Andre Michaelis, Wedemark (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 485 days.

(21) Appl. No.: 12/524,354

(22) PCT Filed: Jan. 30, 2008

(86) PCT No.: PCT/EP2008/000692

§ 371 (c)(1),
(2), (4) Date: Mar. 22, 2010

(87) PCT Pub. No.: WO2008/092645

PCT Pub. Date: Aug. 7, 2008

(65) Prior Publication Data

US 2010/0183173 A1 Jul. 22, 2010

(30) Foreign Application Priority Data

Jan. 31, 2007 (DE) ..... 10 2007 005 620

(51) Int. Cl.
*H04R 1/00* (2006.01)

(52) U.S. Cl.
USPC ..... 381/423; 381/424; 381/398; 181/164; 181/165; 181/173

(58) Field of Classification Search
None
See application file for complete search history.

(56) References Cited

U.S. PATENT DOCUMENTS

| | | | | |
|---|---|---|---|---|
| 1,990,409 | A * | 2/1935 | Lawrance | 181/164 |
| 3,979,566 | A * | 9/1976 | Willy | 381/401 |
| 4,315,112 | A * | 2/1982 | Hofer | 381/186 |
| 4,644,581 | A * | 2/1987 | Sapiejewski | 381/74 |

(Continued)

FOREIGN PATENT DOCUMENTS

| | | | |
|---|---|---|---|
| GB | 2440768 | A | 2/2008 |
| JP | 6086385 | A | 3/1994 |
| WO | WO 2006033075 | A1 | 3/2006 |

OTHER PUBLICATIONS

PCT Search Report of the International Searching Authority mailed on Oct. 16, 2008 for International Application No. PCT/EP2008/000692; 1 page.

(Continued)

*Primary Examiner* — Duc Nguyen
*Assistant Examiner* — Taunya McCarty
(74) *Attorney, Agent, or Firm* — Kilpatrick Townsend & Stockton LLP

(57) ABSTRACT

There is provided a dynamic sound transducer having a diaphragm system (10) which has at least a first and second metallized surface (11) which are separated from each other by an insulating surface (12). The dynamic sound transducer further has a moving coil (20) with a coil wire (25). An end of the coil wire is electrically conductingly connected to the first metallized surface (11) and the other end of the coil wire is electrically conductingly connected to the second metallized surface (11).

10 Claims, 5 Drawing Sheets

(56) References Cited

U.S. PATENT DOCUMENTS

| | | | | |
|---|---|---|---|---|
| 1,931,886 | A | 10/1993 | Schlenker | |
| 6,038,330 | A * | 3/2000 | Meucci, Jr. | 381/371 |
| 6,320,970 | B1 | 11/2001 | Czerwinski et al. | |
| 6,320,972 | B1 * | 11/2001 | Goller | 381/430 |
| 7,317,809 | B2 * | 1/2008 | Almqvist | 381/371 |
| 2002/0051556 | A1 | 5/2002 | Button | |
| 2002/0094097 | A1 * | 7/2002 | Sagren | 381/182 |
| 2004/0141629 | A1 | 7/2004 | Liao | |
| 2005/0238197 | A1 * | 10/2005 | Chang | 381/396 |
| 2006/0188121 | A1 | 8/2006 | Tsunoda | |
| 2006/0204016 | A1 * | 9/2006 | Pham et al. | 381/74 |

OTHER PUBLICATIONS

"Köpfhör" (hedphones) Wikipedia article http://de.wikipedia.org/w/index.php?title=Kopfhörer&oldid=25510391 (Dec. 25, 2006).

* cited by examiner

DYNAMIC SOUND TRANSDUCER AND RECEIVER

CROSS-REFERENCES TO RELATED APPLICATIONS

This application is a U.S. National Stage of International Application No. PCT/EP2008/000692, filed Jan. 30, 2008, which claims the benefit of German Patent Application No. 102007005620.8, filed Jan. 31, 2007, the contents of both applications being hereby incorporated by reference in their entirety.

The present invention concerns a dynamic sound transducer and a receiver or earphone.

BACKGROUND

In conventional dynamic sound transducers, a moving coil is provided in the region of the diaphragm corrugation, wherein coil wires are used for contacting the moving coil. The coil wires thus connect the edge of the diaphragm and the moving coil. The provision of such coil wires is however very complicated and expensive in terms of production engineering in the manufacture of dynamic sound transducers, and can lead to the sound transducers being rejected, for example if there are distortion phenomena or if coil wires tear away. As the coil wires are typically placed only on one side of the diaphragm an asymmetrical mechanical force can be exerted on the moving coil so that unwanted wobbling of the diaphragm can occur.

US No 2004/0141629 A1 discloses a dynamic sound transducer having a diaphragm, with a moving coil being arranged in the region of the diaphragm corrugation. Provided at the edge of the diaphragm are two electrodes connected to the moving coil. The connecting portions between the electrodes and the moving coil are coated with an electrically conductive polymer layer.

Dynamic sound transducers also typically have a diaphragm with a corrugation or ridge and a cap-shaped portion. In that case the upper limit frequency of such a dynamic sound transducer depends on the magnitude of the surface which emits sound. The larger the sound-emitting surface area, the lower are the upper limit frequencies of the frequency characteristic. If the sound-emitting surface area is increased it is possible to reproduce an audio signal with a reduced level of distortion.

In the loudspeaker area, ring radiators having a resonance frequency in the kHz range are known as dynamic sound transducers.

Therefore an object of the present invention is to provide a dynamic sound transducer which permits improved reproduction.

SUMMARY

Thus there is provided a dynamic sound transducer having a diaphragm system which has at least a first and second metallized surface which are separated from each other by an insulating surface. The dynamic sound transducer further has a moving coil with a coil wire. An end of the coil wire is electrically conductingly connected to the first metallized surface and the other end of the coil wire is electrically conductingly connected to the second metallized surface.

In accordance with an aspect of the present invention the diaphragm system is arranged in a chassis. At least two contact elements are arranged on the chassis in such a way that the first contact element is electrically conductingly connected to the first metallized surface and the second contact element is electrically conductingly connected to the second metallized surface.

The present invention also concerns a sound transducer comprising a diaphragm system which has a first and second ridge, and a moving coil arranged in the region between the first and second ridges.

The invention also concerns a dynamic sound transducer comprising a diaphragm, a moving coil, and a magnet system. In that case the magnet system has a magnet ring comprising a plurality of magnet segments.

The invention further concerns an earphone having a sound transducer and a curved sound baffle.

The invention concerns the notion of providing a dynamic sound transducer having a diaphragm which is coated (semi-laterally) with a conducting coating. In that case the center of the diaphragm can have an insulating strip which does not have a conductive coating. Thus the surface of the conducting coating can be divided into two mutually insulated portions. In that case the coil wires of the coil can be cut off short and electrically conductingly fixed or glued to the diaphragm in immediate proximity with the coil so that an electrical connection to the diaphragm edge is afforded by way of the conductive layer of the diaphragm. The chassis of the dynamic transducer can have two conducting paths, wherein the diaphragm is fixed or glued with the conductive coating in or to the chassis so that the conductive coating of the diaphragm involves conductive contact with the chassis.

As there are no longer any moving coil wires between the coil and the diaphragm edge the above-indicated problems cannot arise.

Further configurations of the invention are subject-matter of the appendant claims.

BRIEF DESCRIPTION OF THE DRAWINGS

Embodiments by way of example and advantages of the invention are described in greater detail hereinafter with reference to the drawing.

DETAILED DESCRIPTION

Figure 1A:
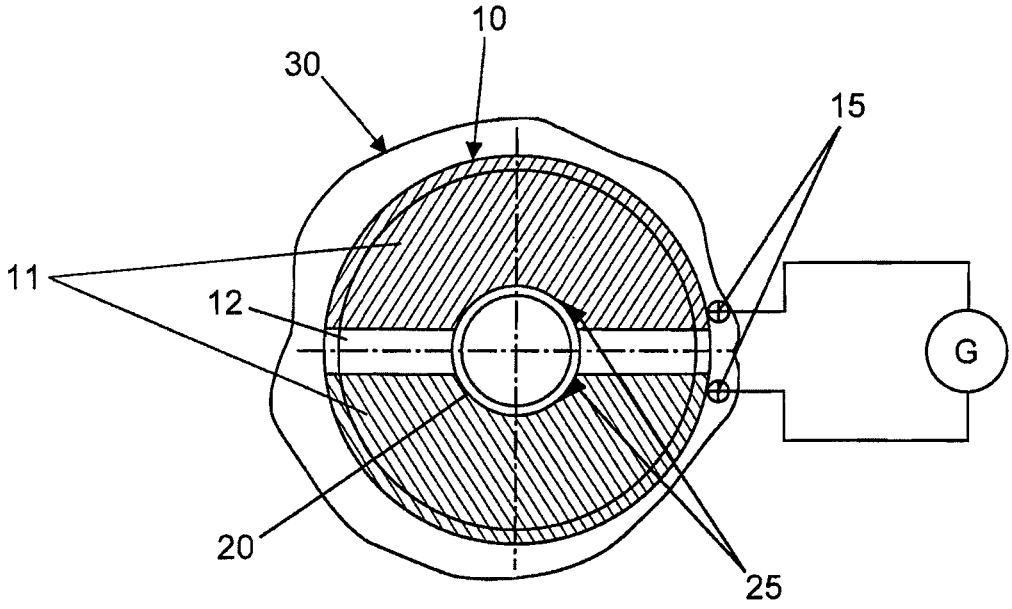
FIG. 1*a* shows a diagrammatic plan view of a diaphragm in accordance with a first embodiment.

FIG. 1*a* shows a plan view of a diaphragm system of a dynamic sound transducer in accordance with a first embodiment. The diaphragm 10 is connected to a moving coil 20 and embedded in a chassis 30. The diaphragm 10, on its one side, has two metallized surfaces 11 and an insulating, that is to say not electrically coated, portion 12 between the two metallized surfaces 11. The coil wires 25 of the moving coil 20 are respectively conductingly glued onto one of the metallized surfaces 11 or conductingly connected to the metallized surfaces 11. Provided at the edge of the diaphragm 10 and on the chassis 30 are two contact elements 15 which are respectively conductingly connected for example by adhesive to the two metallized surfaces 11. The two electrical contact elements serve to couple the moving coil by way of the electrically conducting surfaces to an electric circuit G which for example serves to supply the moving coil with a signal.

Figure 1B:
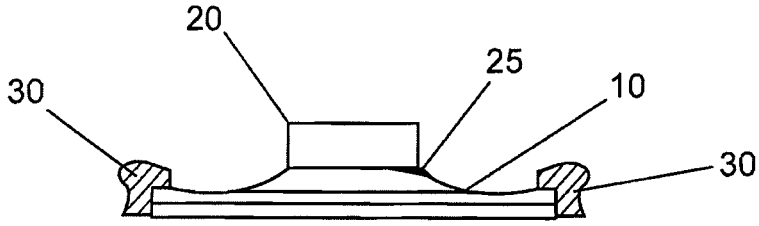
FIG. 1*b* shows a sectional view of the diaphragm of FIG. 1*a*.

FIG. 1*b* shows a sectional view of the diaphragm system in FIG. 1*a*. The diaphragm 10 is arranged in a chassis 30 and has a moving coil 20 with a coil wire 25.

A process by way of example for the production of a dynamic sound transducer as set forth hereinbefore is described in detail hereinafter.

One side of the diaphragm, preferably the underside, is coated for example in a sputtering process with an electrically conductive layer 11. To provide an insulating portion 12 a part of the diaphragm can be covered over during the sputtering process. The conductive layer 11 can be produced for example by sputtering AI (some Angströms) and by sputtering AU (about 2000 Angströms). Thus there are two electric contact surfaces 11 which are insulated or separated from each other by the insulating portion 12. Those electric contact surfaces 11 serve to electrically conductingly connect together the diaphragm seat and the coil seat. The connecting wires 25 of a moving coil 20 are then bent inwardly, the insulation of the connecting wires of the moving coil are thermally stripped in the region near the coil (at about 380°) and shortened. The connecting wires 25 of the moving coil 20 can then be fitted onto and fixed on the diaphragm 10 in conventional fashion. The two stripped and shortened connecting wires 25 of the moving coil 20 are electrically conductingly connected together or glued to the two contact surfaces 11 of the electrically conducting layer. The chassis 30 of the dynamic sound transducer, at the diaphragm seat, has two wires 15 which are connected to a circuit board in the dynamic sound transducer. The diaphragms 10 are fitted into the chassis 30 and the wires are correspondingly contacted. The diaphragm can be glued into the chassis or secured thereto.

Thus there can be provided a dynamic sound transducer having a nominal resistance slightly greater than the nominal resistance of the coil. Preferably the contacting arrangement only has a contact resistance of a few ohms. The insulating portion 12 can preferably be smaller than the first and second electrically conductive surfaces 11. That permits simple and locally flexible contacting of the wires 15 as one of the wires 15 can be connected to the first conductive surface at any location, preferably in the proximity of the outer edge. The other wire is correspondingly connected to the second conductive surface. Preferably one side of the diaphragm is provided with a central strip-shaped insulating portion 12 and the remaining approximately semicircular surfaces of one side of the diaphragm are coated with the first and second electrically conductive surface. The first and second electrically conductive surface which is as large as possible also makes it possible to achieve a low level of electrical resistance between the wires 15 and the connecting wires 25. Such a dynamic sound transducer can preferably be used in headphones, an earphone or in a listen-talk fitting.

Figure 2A:
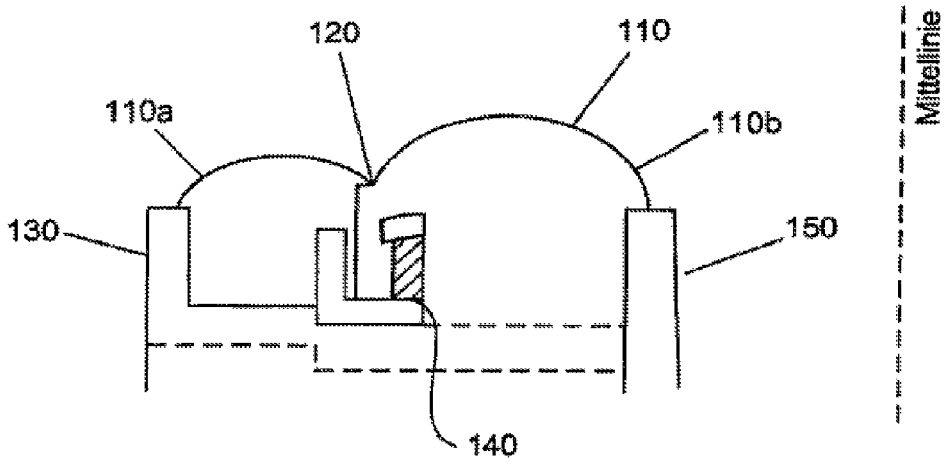
FIG. 2*a* shows a sectional view of a dynamic transducer in accordance with a second embodiment.

FIG. 2*a* shows a sectional view of a dynamic sound transducer in accordance with a second embodiment. The dynamic sound transducer has a chassis 130, a diaphragm 110 with two ridges 110*a*, 110*b*, a moving coil 120 and a magnet system 140.

Figure 2B:
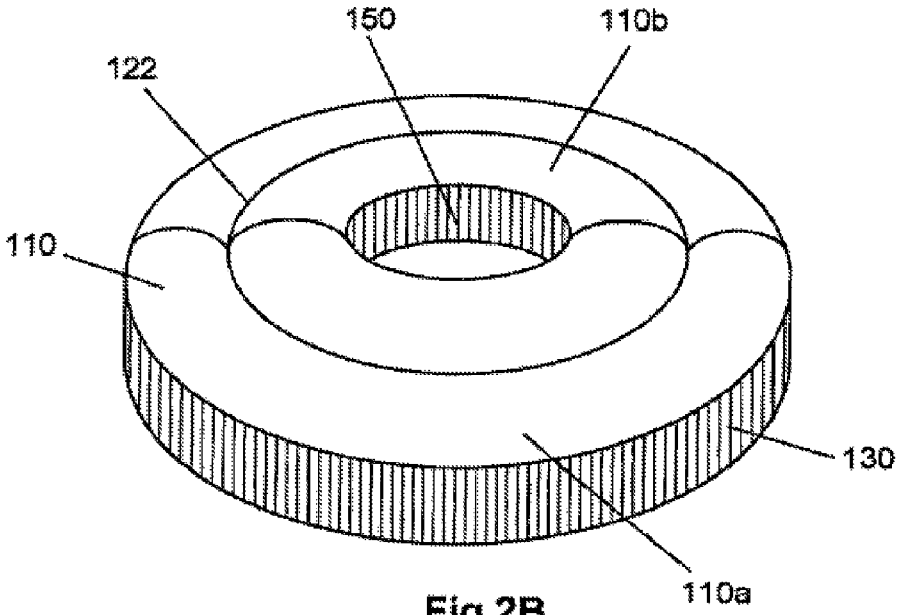
FIG. 2*b* shows a perspective view of the dynamic transducer of FIG. 2*a*.

FIG. 2*b* shows a perspective diagrammatic view of a dynamic sound transducer as shown in FIG. 2*a*. In this case the dynamic sound transducer has two ridges but no cap-shaped portion, that is to say there is a hole 150 in the center of the diaphragm.

Figure 2C:
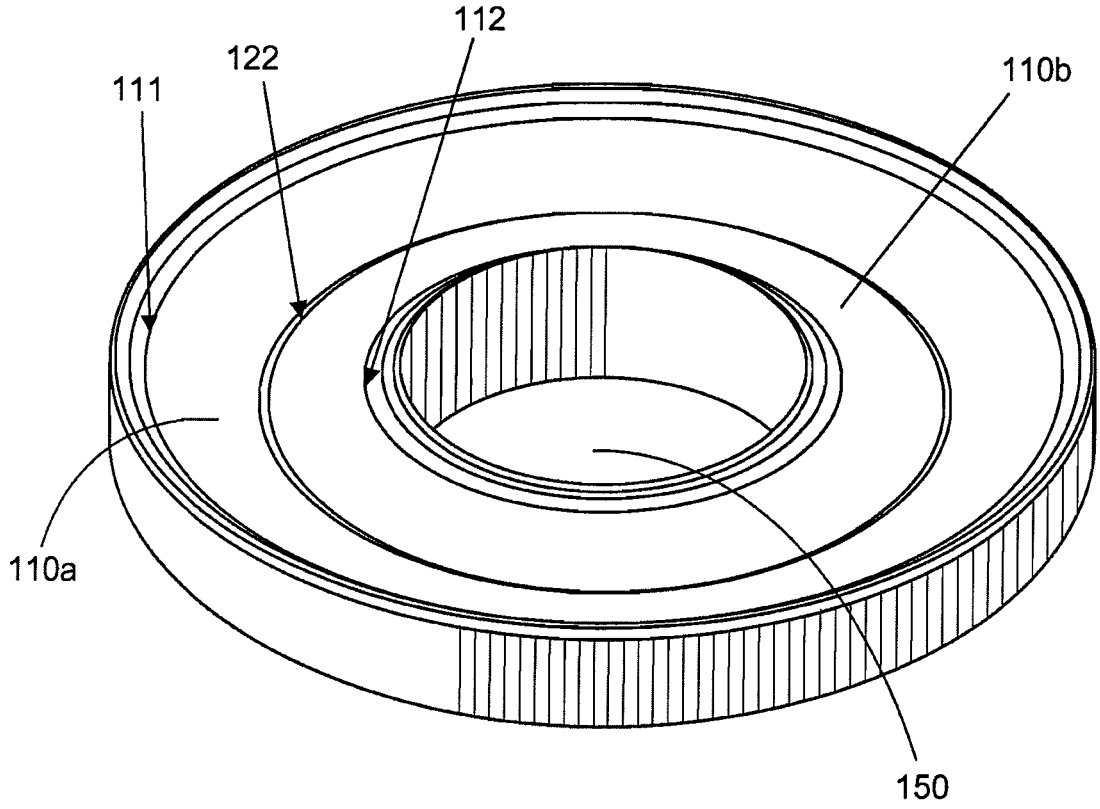
FIG. 2*c* shows a further perspective view of the dynamic transducer of FIG. 2*a*.

FIG. 2*c* shows a further perspective view of a dynamic sound transducer as in FIG. 2*a*. In particular the corresponding diaphragm system is shown here. The diaphragm system has an outer diaphragm support means 111 and an inner diaphragm support means 112 as well as a through-passage or hole 150. A first ridge 110*a* is provided between the outer diaphragm support means 111 and the coil seat 122 and a second ridge 110*b* is provided between the coil seat 122 and the inner diaphragm support means 112.

The second embodiment therefore involves the notion of reducing or avoiding distortion phenomena which occur, by the diaphragm surface area being increased, with an upper limit frequency being maintained. In addition there is provided a dynamic sound transducer having a reduced resonance frequency so that such a sound transducer can be used as a wideband transducer. A greater periphery relative to the cap-shaped transducer is provided to reduce the oscillation modes.

The invention thus concerns the notion of providing a dynamic sound transducer having two ridges 110*a*, 110*b*, but without a cap-shaped portion. In this case the two ridges 110*a*, 110*b* are fixed at the inside and outside to the chassis 130 of the dynamic transducer. A coil 120 for driving the diaphragm is provided in the center 122 between the outer and inner ridges 110*a*, 110*b*. In the region of the diaphragm where the coil is arranged, that is to say at the coil seat 122, the diaphragm 110 is stiff, which can be achieved by the diaphragm being of a suitable contour. The diaphragm also becomes softer towards the edge regions, that is to say the diaphragm support means 111, 112. The fact that the diaphragm is not of a uniform stiffness means that the magnitude of the sound-emitting surface area depends on the frequency. At low frequencies a large part of the ridges 110*a*, 110*b* oscillates homogenously with the coil 120 and thus represents a large sound-emitting area. If however the frequency is raised only a near region of the coil seat 122 oscillates so that the sound-emitting area is reduced. Thus high frequency components can be correspondingly emitted. The upper limit frequency of the dynamic sound transducer is adjusted in this case outside the audible range.

If the active sound-emitting surface of the dynamic sound transducer is increased in size, shorter stroke movements are made possible for producing the sound signals, and that can reduce distortion.

The dynamic sound transducer in accordance with a second embodiment has a ring radiator with a vapor-deposited film (Duofol) to reduce the resonance frequency. Thus there can be provided a wideband transducer which can be used for example in open earphones.

The diaphragm of the dynamic sound transducer can be vapor-deposited. Oscillation modes can propagate worse due to the enlarged periphery of the diaphragm. It is thus possible to achieve a regular amplitude and frequency characteristic.

Figure 3A:
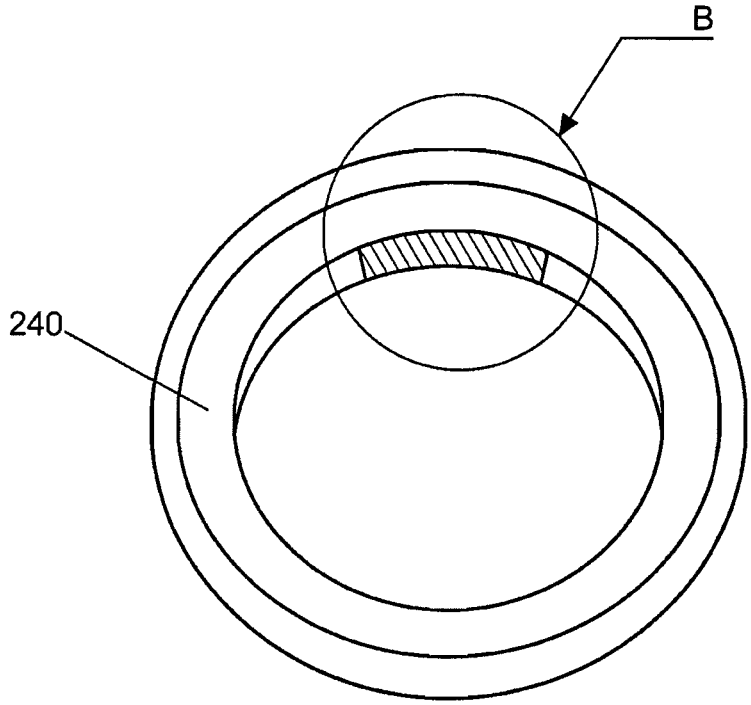
FIG. 3*a* shows a perspective view of a magnet ring for a dynamic sound transducer in accordance with a third embodiment.

FIG. 3*a* shows a perspective view of a magnet ring for a dynamic transducer in accordance with a third embodiment. The magnet ring 240 shown in FIG. 3*a* can be used for example in the dynamic sound transducer in FIG. 2*a* or in the magnet system 140 of the dynamic sound transducer in FIG. 2*a*.

Figure 3B:
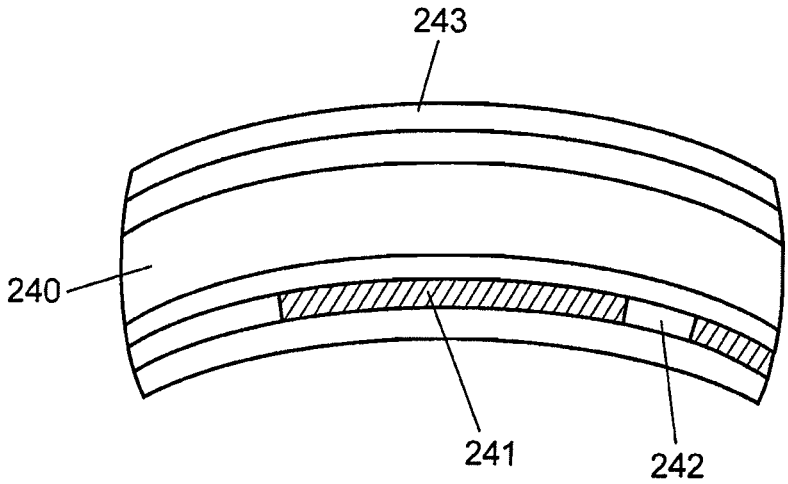
FIG. 3*b* shows a view on an enlarged scale of the portion B in FIG. 3*a*.

FIG. 3*b* shows a portion B in FIG. 3*a* on an enlarged scale. The magnet ring 240 is of a substantially U-shaped cross-section, in which respect the arrangement does not involve a complete magnet ring but only magnet segments 241 in the U-shaped magnet ring. There are thus air gaps 242 between the magnet segments 241.

For venting the air gap in the magnet system the magnet system is of an annular configuration, the arrangement not having a complete magnet ring but only magnet segments 241. The air gaps 242 which are produced in that case between the magnet segments 241 thus permit the air to escape in the region of the magnet system. In that case the air escapes in particular to the inside of the magnet system when the moving coil performs major movements. In that way it is possible to avoid the otherwise usual compression phenomena in respect of the air cushion in the region of the air gap of the magnet system. It is thus possible to avoid in particular unwanted acoustic bouncing due to compression of the air cushion. In addition the provision of the magnet segments 241 makes it possible to prevent air flows between the various regions of a diaphragm system such as for example between a ridge region and a cap-shaped region or between an inner and an outer ridge (as shown for example in FIGS. 2*a* through 2*c*), through the air gap.

Figure 4:
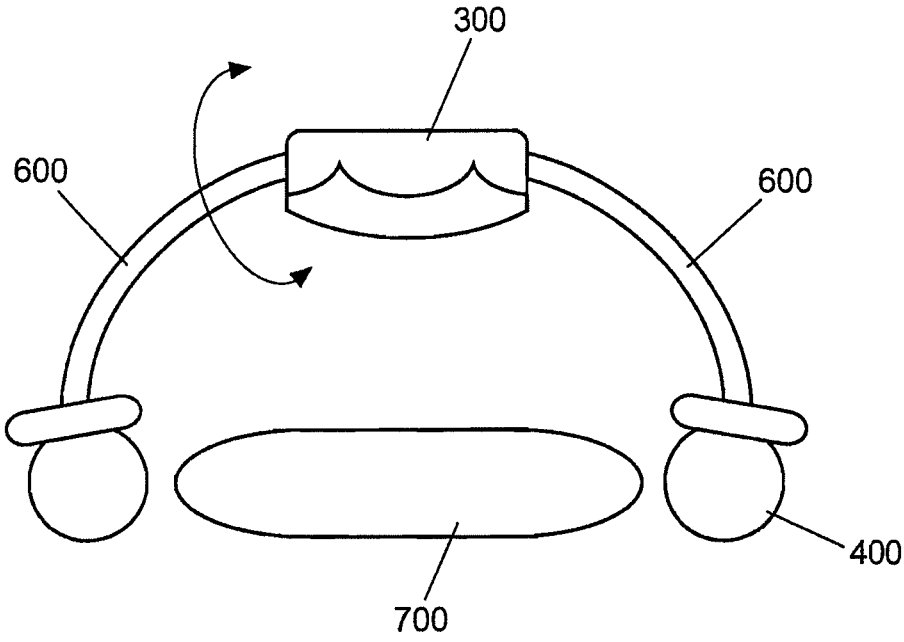
FIG. 4 shows an earphone in accordance with a fourth embodiment.

FIG. 4 shows a diagrammatic sectional view of headphones in accordance with a fourth embodiment. The headphones have a sound transducer 300, ear pads 400 and an acoustic baffle 600. In operation the headphones are placed over an ear 700 by means of the ear pads 400.

While conventional acoustic transducers of headphones are typically embedded in or on a flat acoustic baffle the headphones in accordance with the fourth embodiment have a curved acoustic baffle 600.

The flat acoustic baffle in the state of the art and its corresponding acoustic permeability serve to control the acoustic path to the outside world and to the rear side of the sound transducer. To protect the transducer grills or similar elements are often arranged on the rear side of the sound transducer. Those elements however can give rise to unwanted reflection phenomena which can influence acoustic reproduction of the sound transducer.

In accordance with the fourth embodiment the acoustic baffle 600 is of a curved configuration and at the same time represents an outer wall or enclosure for the headphones. There are therefore no unwanted acoustic effects due to an additional protective housing. Reflection-free closure towards the outside world can thus be achieved by means of the curved acoustic baffle 600.

The invention claimed is:

1. A wideband dynamic sound transducer comprising:

a chassis including an annular inner diaphragm support means and an annular outer diaphragm support means;

a diaphragm system including a single diaphragm having first and second ridges, wherein the first ridge is coupled to the annular inner diaphragm support means of the chassis and the second ridge is coupled to the annular outer diaphragm support means of the chassis, wherein the diaphragm system has a hole in the center defined by the annular inner diaphragm support means of the chassis; and a moving coil coupled to a coil seat configured between the first and second ridges, wherein a stiffness of the diaphragm is lower toward the annular inner diaphragm support means and the annular outer diaphragm support means, causing a larger portion of the diaphragm to oscillate homogenously with the moving coil at low frequencies, and wherein the stiffness of the diaphragm is higher toward the coil seat, causing a smaller portion of the diaphragm to oscillate homogenously with the moving coil at high frequencies.

2. A wideband dynamic sound transducer as set forth in claim 1 further comprising:

a magnet system, wherein the magnet system has a magnet ring comprising a plurality of magnet segments.

3. A wideband dynamic sound transducer as set forth in claim 2 wherein there is at least one air gap between the magnet segments.

4. An open earphone including at least one wideband sound transducer, the wideband sound transducer comprising:

a chassis including an annular inner diaphragm support means and an annular outer diaphragm support means;

a diaphragm system including a single diaphragm having first and second ridges, wherein the first ridge is coupled to the annular inner diaphragm support means of the chassis and the second ridge is coupled to the annular outer diaphragm support means of the chassis, wherein the diaphragm system has a hole in the center defined by the annular inner diaphragm support means of the chassis; and a moving coil coupled to a coil seat configured between the first and second ridges, wherein a stiffness of the diaphragm is lower toward the annular inner diaphragm support means and the annular outer diaphragm support means, causing a larger portion of the diaphragm to oscillate homogenously with the moving coil at low frequencies, and wherein the stiffness of the diaphragm is higher toward the coil seat, causing a smaller portion of the diaphragm to oscillate homogenously with the moving coil at high frequencies.

5. An open earphone as set forth in claim 4 further comprising:

a magnet system, wherein the magnet system has a magnet ring comprising a plurality of magnet segments.

6. An open earphone as set forth in claim 5 wherein there is at least one air gap between the magnet segments.

7. A wideband dynamic sound transducer as set forth in claim 1 wherein the single diaphragm is vapor-deposited.

8. An wideband dynamic sound transducer as set forth in claim 1 wherein the low frequencies and high frequencies are in the audio spectrum.

9. An open earphone as set forth in claim 5 wherein the single diaphragm is vapor-deposited.

10. An open earphone as set forth in claim 5 wherein the low frequencies and high frequencies are in the audio spectrum.

* * * * *

UNITED STATES PATENT AND TRADEMARK OFFICE

CERTIFICATE OF CORRECTION

PATENT NO. : 8,731,231 B2
APPLICATION NO. : 12/524354
DATED : May 20, 2014
INVENTOR(S) : Teske-Fischer et al.

It is certified that error appears in the above-identified patent and that said Letters Patent is hereby corrected as shown below:

In the Claims:

In column 5, line 54, claim 1, please add "and" before "wherein the diaphragm system".

In column 6, line 10, claim 2, please add a "," after "transducer".

In column 6, line 11, claim 2, please add a "," after "claim 1".

In column 6, line 15, claim 3, please add a "," after "transducer".

In column 6, line 16, claim 3, please add a "," after "claim 2".

In column 6, line 27, claim 4, please add "and" before "wherein the diaphragm system".

In column 6, line 42, claim 5, please add a "," after "earphone".

In column 6, line 42, claim 5, please add a "," after "claim 4".

In column 6, line 47, claim 6, please add a "," after "earphone".

In column 6, line 47, claim 6, please add a "," after "claim 5".

In column 6, line 48, claim 7, please add a "," after "transducer".

In column 6, line 49, claim 7, please add a "," after "claim 1".

In column 6, line 51, claim 8, please delete "An wideband" and insert --A wideband--.

In column 6, line 51, claim 8, please add a "," after "transducer".

In column 6, line 52, claim 8, please add a "," after "claim 1".

In column 6, line 54, claim 9, please add a "," after "earphone".

In column 6, line 54, claim 9, please add a "," after "claim 5".

In column 6, line 54, claim 10, please add a "," after "earphone".

In column 6, line 54, claim 10, please add a "," after "claim 5".

Signed and Sealed this
Ninth Day of September, 2014

Michelle K. Lee

Michelle K. Lee
*Deputy Director of the United States Patent and Trademark Office*